US007455060B2

(12) United States Patent
Burnett et al.

(10) Patent No.: US 7,455,060 B2
(45) Date of Patent: Nov. 25, 2008

(54) STARTUP BURNER ASSEMBLY FOR SNOW MELTING APPARATUS AND METHOD OF SNOW MELTING

(75) Inventors: David Burnett, Boutiliers Point (CA); Steven Meredith, Stillwater Lake (CA); Glen Burnett, Halifax (CA)

(73) Assignee: Trecan Combustion Limited, Nova Scotla (CA)

( * ) Notice: Subject to any disclaimer, the term of this patent is extended or adjusted under 35 U.S.C. 154(b) by 529 days.

(21) Appl. No.: 11/170,623

(22) Filed: Jun. 29, 2005

(65) Prior Publication Data

US 2006/0137677 A1 Jun. 29, 2006

(51) Int. Cl.
*E01H 5/10* (2006.01)
*F24C 15/16* (2006.01)

(52) U.S. Cl. ..... 126/343.5 R; 126/343.5 A; 126/271.1; 431/350; 431/278; 431/158; 431/160; 219/421; 432/78; 432/84; 122/31.1; 122/31.2

(58) Field of Classification Search ..... 431/350, 431/278, 158, 160; 126/343.5 R, 343.5 A, 126/271.1; 219/421; 432/78, 84; 122/31.1, 122/31.2

See application file for complete search history.

(56) References Cited

U.S. PATENT DOCUMENTS

| | | | | |
|---|---|---|---|---|
| 3,304,632 A | | 2/1967 | Kotlar et al. | |
| 4,164,820 A | | 8/1979 | Krickovich | |
| 5,235,762 A | | 8/1993 | Brady | |
| 5,266,220 A | | 11/1993 | Hammond et al. | |
| 5,615,666 A | * | 4/1997 | Ransom | 126/25 R |
| 5,615,668 A | * | 4/1997 | Panz et al. | 126/360.2 |
| 5,791,335 A | | 8/1998 | Luciani | |
| 6,238,207 B1 | * | 5/2001 | Sarkinen | 431/353 |
| 6,293,277 B1 | * | 9/2001 | Panz et al. | 126/360.2 |
| 6,305,105 B1 | | 10/2001 | Lowman | |
| 6,360,738 B1 | | 3/2002 | Brooks | |
| 6,736,129 B1 | | 5/2004 | Smith | |
| 2004/0074114 A1 | | 4/2004 | Rogers | |

FOREIGN PATENT DOCUMENTS

| | | |
|---|---|---|
| CA | 712840 | 7/1965 |
| CA | 741959 | 9/1966 |
| CA | 769461 | 10/1967 |
| CA | 825952 | 10/1969 |
| CA | 907989 | 8/1972 |
| CA | 2450796 | 12/2003 |
| CA | 2491322 | 12/2004 |

* cited by examiner

*Primary Examiner*—Steven B McAllister
*Assistant Examiner*—Nikhil Mashruwala

(57) ABSTRACT

A startup burner assembly for use in snow melting applications, and which permits initiation of snow melting without first supplying water as a coolant. The startup burner assembly comprises a fuel burner having adjustable combustion output and a nozzle to facilitate the emergence of products of combustion, and a combustion chamber having a first portion in substantially air-tight communication with the fuel burner and enclosing the nozzle and a second portion shaped and dimensioned for disposition into a snow melting receptacle or pit. The combustion chamber has a plurality of discharge holes formed at least on the second portion thereof to permit the egress of products of combustion from the fuel burner into the tank or pit, and thereby permit agitation and melting of snow loaded therein, The startup burner assembly also includes an air cooling assembly for supplying air to cool at least the first portion of the combustion chamber.

24 Claims, 5 Drawing Sheets

STARTUP BURNER ASSEMBLY FOR SNOW MELTING APPARATUS AND METHOD OF SNOW MELTING

FIELD OF THE INVENTION

The present invention relates to snow melting equipment, and more specifically, to improvements in traditional snow melters which utilize heat to melt and thus dispose of large amounts of snow. In particular, the invention relates to a startup snow melting apparatus which permits burner ignition without initially supplying water as a coolant.

BACKGROUND OF THE INVENTION

Snow melting devices known in the art commonly utilize a burner unit or assembly to provide heat to a snow melting medium, typically water. The heated medium is then used in various ways to melt the snow.

Canadian Patent No. 780,673 and U.S. Pat. No. 3,187,743 (both to Primas) disclose a snow melting device commonly known in the art. This device includes a tank and a fuel burner assembly. The burner assembly includes a downwardly extending downcomer tube which encloses the fuel burner nozzle. The downcomer tube is provided with an opening at the bottom for the outflow of combustion gases from the sides, and a closure plate disposed over the end thereof at a slight distance therefrom. A tubular housing, or weir, is provided around the downcomer tubs with a bottom opening, and with an upper opening at a location above the lower end of the downcomer tube for the outflow of combustion gases and hot water. The burner assembly is positioned inside the tank, into which snow is introduced for melting. In operation, water is supplied to a specified height in the tank, the burner is ignited, and combustion gases are discharged downwardly from the burner nozzle through the downcomer tube and out through the bottom openings beneath the water surface. The combustion gases, on exiting the "slots" (20), break down into millions of minute bubbles as they contact the water present in the annular space. The instantaneous mixing and transfer of heat to the water causes an immediate decrease in bulk density of the mixture causing the mixture to rise vertically up the annular space inside the weir and violent discharge thereof out of the opening at the top of the weir. A deflector plate positioned at the top opening directs the heated water laterally onto the snow in the tank. The heated water strikes the upper surface of the snow in the tank and melts it. The tank disclosed by Primas is designed to maintain a body of water as a melting source and for cooling of the burner assembly.

U.S. Pat. No. 6,736,129 (Smith) discloses another example of a snow melting apparatus in which a container, or tank is provided with a burner having a modified combustion chamber. At least a portion of the combustion chamber is submerged in the snow melting medium, i.e. water. The submerged portion of the combustion chamber includes a horizontally extending sparger tube through which combustion gases emerge. The combustion gases cause nucleate boiling and strong agitation from below the water level and thereby accelerate the melting process. The disclosed snow melting apparatus also includes a mechanism for removing debris from the snow, and a control mechanism to maintain an optimal water temperature for maximum fuel efficiency. A pumped recirculating water system is also described for cooling the portion of the combustion chamber not submerged in the snow melting medium.

A variety of other examples of snow melters are also know in the art. For instance, U.S. Pat. No, 6,305,105 (Lowman) discloses a device for disposing of snow deposited on a surface e.g., roadways, sidewalks, etc. The apparatus includes a mechanism that removes snow from the surface and guides it into a snow melting apparatus comprising three chambers. Within the first chamber, heated, pressurized water is sprayed onto the snow to aid in the melting process. The second chamber has an agitating device that moves and separates the snow/water mixture into a slurry to melt it. The third chamber, or tank, is connected to the second chamber and stores the melted snow. The system further includes a screen to prevent stones or other debris from entering the heat chamber.

In U.S. Pat. No. 5,235,762 (Brady), a snow melting apparatus is described having a reduction chamber into which heated air is forced by a burner. Heated water is also distributed within the reduction chamber by using a pump and perforated pipes. The burner is controlled by a thermostat to keep the temperature of the water consistent. The water used for the snow melting process is stored in a separate reservoir.

U.S. Pat. No. 5,791,335 (Luciani) discloses a snow melting apparatus comprising a hopper which forms a lower trough, a pivoting ram/screen assembly to prevent large debris from passing to the trough, and a manifold having a plurality of rotating sprinkler heads for discharging heated water onto the snow and debris introduced into the hopper.

United States Patent Application Publication No. 2004/0074114 and Canadian Patent Application No. 2,450796 (both to Rogers) describe a snow removal system comprising a container having a storage chamber adapted to store snow and a predetermined amount of water, and a heating assembly which is at least partially disposed in the storage chamber. The heating assembly is adapted to heat water stored in the storage chamber to a selected temperature. The system also includes a mixing system adapted to pressurize water and discharge the pressurized water onto the snow. Debris can be evacuated using a door disposed on a wall of the storage chamber.

Canadian Patent No. 769,461 (Petlak) describes a snow melting machine having manifold ducts and pipes placed in parallel to evenly distribute hot gases in a melting chamber. Hot gases are expelled in a downward direction below the water level in the tank toward the bottom of the chamber. The apparatus thus requires the tank to be filled with water prior to initiating the melting process.

Canadian Patent No. 907,989 (Coslowsky) discloses an automatic snow melter comprising a melting chamber mounted on a truck, a rotary agitator for agitating the snow and means for separating debris and rocks. In the melting chamber, the snow is passed under gas jets which quickly melt the snow to fill the chamber with water.

Canadian Patent No. 741,959 (Gontcharuk) discloses a snow disposal apparatus comprising a rotatable heating chamber for continuously mixing snow and water, and burners that allow for hot air to be blown into a tube which is horizontally fixed under the snow.

Canadian Patent No. 712,840 (Glaser et al) describes a snow melting apparatus which uses hot combustion gases to preheat water in a melting chamber. When the water of the melting chamber reaches a certain temperature, snow or ice is added to the chamber for melting.

A common problem of such prior art devices is that water must be supplied in sufficient quantity to provide cooling of the burner assembly prior to ignition of the burner. This results in a need for water to be readily available at the site of operation, restricting the use of such equipment to sites having a water source in close proximity. Otherwise, water must be transported from site to site in a reservoir associated with the snow melter.

SUMMARY OF THE INVENTION

It is therefore an object of the present invention to provide a startup burner assembly for a snow melting apparatus which permits burner ignition without initially supplying water as a coolant.

Accordingly, as an aspect of the present invention, there is provided a startup burner assembly for use in a snow melting apparatus, the startup burner assembly comprising:

a fuel burner having adjustable combustion output and including a nozzle to facilitate the emergence of products of combustion, a combustion chamber having a first portion in substantially air-tight communication with the fuel burner and enclosing the nozzle, and a second portion shaped and dimensioned for disposition into a snow melting receptacle or pit, the combustion chamber having a plurality of discharge holes formed at least on the second portion thereof to permit the egress of products of combustion from the fuel burner into the tank or pit, and thereby permit agitation and melting of snow loaded therein, and an air cooling assembly for supplying air to cool at least the first portion of the combustion chamber.

The air cooling assembly typically comprises an air supply tube for supplying air from an air supply means to an air injection manifold, the manifold being formed around the combustion chamber and having holes facilitating the emergence of air to cool the combustion chamber. The air supply means may be any device commonly used to supply air, although it is advantageously a device commonly used in conjunction with snow melters. In preferred embodiments of the invention the air supply means is a blower, and particularly, a combustion air blower.

In the startup burner assembly of the invention, the combustion chamber will generally include a downcomer tube as the aforesaid fist portion, and a sparger tube as the aforesaid second portion. The first, or upper end of the downcomer tube is fastened to the burner such that the downcomer tube encloses the fuel burner nozzle, and the second, or lower end is fastened to the sparger tube in substantially perpendicular orientation therewith.

The startup burner assembly will typically further comprise a housing, or weir, which surrounds at least part of the downcomer tube and which is displaced radically outwardly therefrom. By virtue of this arrangement, the housing defines a space between the exterior of the downcomer tube and the interior of the housing. One or more openings are provided, typically at the lower end of the housing to permit air from the manifold and/or water from the rising water level to enter the space and cool the downcomer tube.

The startup burner assembly may also have a jacket arranged around the first portion of the combustion chamber, advantageously proximal to the fuel burner. The jacket is shaped and dimensioned to receive a flow of water for cooling the first portion of the combustion chamber, or downcomer tube.

In the startup burner assembly of the present invention, the discharge holes may be positioned in any arrangement which gives efficient distribution of the combustion gases. However, it is particularly advantageous for the discharge holes to be formed on the upper surface of the second portion of the combustion chamber, or sparger tube, and along substantially the entire length thereof. Discharge holes may also be formed on portions of the downcomer tube.

As another aspect of the present invention, there is provided a snow melting apparatus comprising a receptacle for receiving snow, one or more startup burner assemblies as defined herein, mounted in operable arrangement with the receptacle, at least one air supply means to supply air to the air cooling assembly and combustion chamber of each of the one or more startup burner assemblies, and a controller for controlling the combustion output of the fuel burner of each of the one or more startup burner assemblies.

In the snow melting apparatus of the present invention, the controller preferably comprises a Programmable Logic Controller (PLC) operably linked to the fuel burners of the one or more startup burner assemblies. The PLC may also be operably linked to the air supply means, so as to control the output thereof. Most preferably, the PLC will be adapted to monitor metal temperatures, at least on the startup burner assemblies, and will operate the burners thereof such that preset metal temperatures will not be exceeded.

One or more of the startup burner assemblies of the present snow melting apparatus may comprise an adjacent load burner assembly. Such a load burner assembly may advantageously comprise:

a load burner having a nozzle to facilitate the emergence of products of combustion, a combustion chamber extending downwardly into the receptacle and having a first end in substantially air-tight communication with the load burner and substantially enclosing the nozzle thereof, and an open second end to which an end plate is secured at a distance therefrom to form an annular lateral space between the end plate and the open second end of the combustion chamber, a housing surrounding at least a portion of the combustion chamber and displaced radically outwardly therefrom, the housing defining a space between the exterior of the combustion chamber and the interior of the housing and having upper and lower openings respectively at upper and lower ends of the housing, the lower end of the housing being disposed below the end plate of the combustion chamber.

In the embodiment of the present snow melting apparatus described immediately above, a crossover duct may be included to connect the housing of the load burner assembly with, and supply water to, the jacket of the adjacent startup burner assembly. As described above in connection with the startup burner assembly, the jacket is advantageously arranged around at least part of the first portion of the combustion chamber of the startup burner assembly, preferably proximal to the startup fuel burner, and is shaped and dimensioned to receive water from the housing of the load burner assembly via the crossover duct for cooling of the first portion of the combustion chamber.

The housing of the load burner assembly may also comprise a deflector plate at or near the upper opening thereof. The deflector plate is advantageously provided to laterally deflect water projected from the housing during operation of the snow melter.

The snow melting apparatus may also comprise one or more collecting trays to collect debris accumulated in the receptacle during operation. In order to facilitate evacuation of the collecting trays from the receptacle, the receptacle will preferably include one or more resealable doors having dimensions sufficient to permit removal of the collecting trays therethrough.

Such collection trays generally have a grated bottom, and are advantageously positioned below the combustion chamber of the burner assembly at or near the bottom surface of the receptacle. In this preferred embodiment, the resealable doors are positioned on the sidewall of the receptacle in alignment with the vertical and horizontal position of the collecting tray. It is particularly preferred for the snow melting apparatus to include a plurality of collecting trays and resealable doors such that the collecting trays cover substantially the entire bottom surface of the receptacle. Furthermore, the number of resealable doors are preferably equal to the number of collecting trays included in the snow melting apparatus.

As a further aspect of the present invention, there is provided a method of snow melting comprising the steps of:

providing snow to a snow melting apparatus as defined herein such that the snow is in contact with at least the second portion of the combustion chamber of the startup burner assembly, supplying fuel and oxygen to the fuel burner of the startup burner assembly, igniting the fuel burner of the startup burner assembly, adjusting input of the fuel and oxygen to the fuel burner of the startup burner assembly so as to provide a low burner output, and supplying air to the air cooling assembly of the startup burner assembly to cool at least the first portion of the combustion chamber of the startup burner assembly.

Snow melting according to the aforementioned method is preferably continued at the low burner output until a level of water is obtained from the snow melting which is sufficient to cool at least part of the first portion of the combustion chamber to the startup burner assembly. The input of air and fuel to the fuel burner of the startup burner assembly may then be increased, simultaneously or after the water rises to the aforementioned level.

As yet a further aspect of the present invention, there is provided a snow melting apparatus comprising a receptacle for receiving snow, one or more burner assembly mounted in operable arrangement with the receptacle, and one or more collecting tray, the collecting tray being effective to collect debris which accumulates in the receptacle during operation, and wherein the receptacle comprises one or more resealable door for evacuating the collecting tray from the receptacle.

The collecting tray referred to herein is typically defined by a substantially planar grated bottom and sidewalls extending substantially upwardly therefrom. In particularly preferred embodiments, the sidewalls of the collecting tray are outwardly tapered, or flared, so as to improve the efficiency of the debris removal process.

BRIEF DESCRIPTION OF THE DRAWINGS

Embodiments of the present invention will be further described, by way of example, with reference to the accompanying drawings, in which.

DETAILED DESCRIPTION OF THE INVENTION

Snow melters used in snow removal typically incorporate at least one fuel burner to generate the heat required for melting collected snow. In such devices, overheating of the burner is prevented through the use of water as a coolant. This cooling may be provided by pumping water through a jacket surrounding the burner assembly and/or by immersion of at least a portion of the burner assembly into a reservoir of water. The present invention overcomes this requirement for initial water cooling by providing a startup burner assembly which enables burner ignition without initially supplying water as a coolant.

Most snow melters commonly known and used in the art may be fitted with the burner assembly of the present invention. These include single or multi-burner devices. For illustration FIG. 1*a* shows a double-burner snow melting device which incorporates an example of the startup burner assembly (1) of the present invention, mounted operably to a receptacle, or tank (10).

Figure 1A:
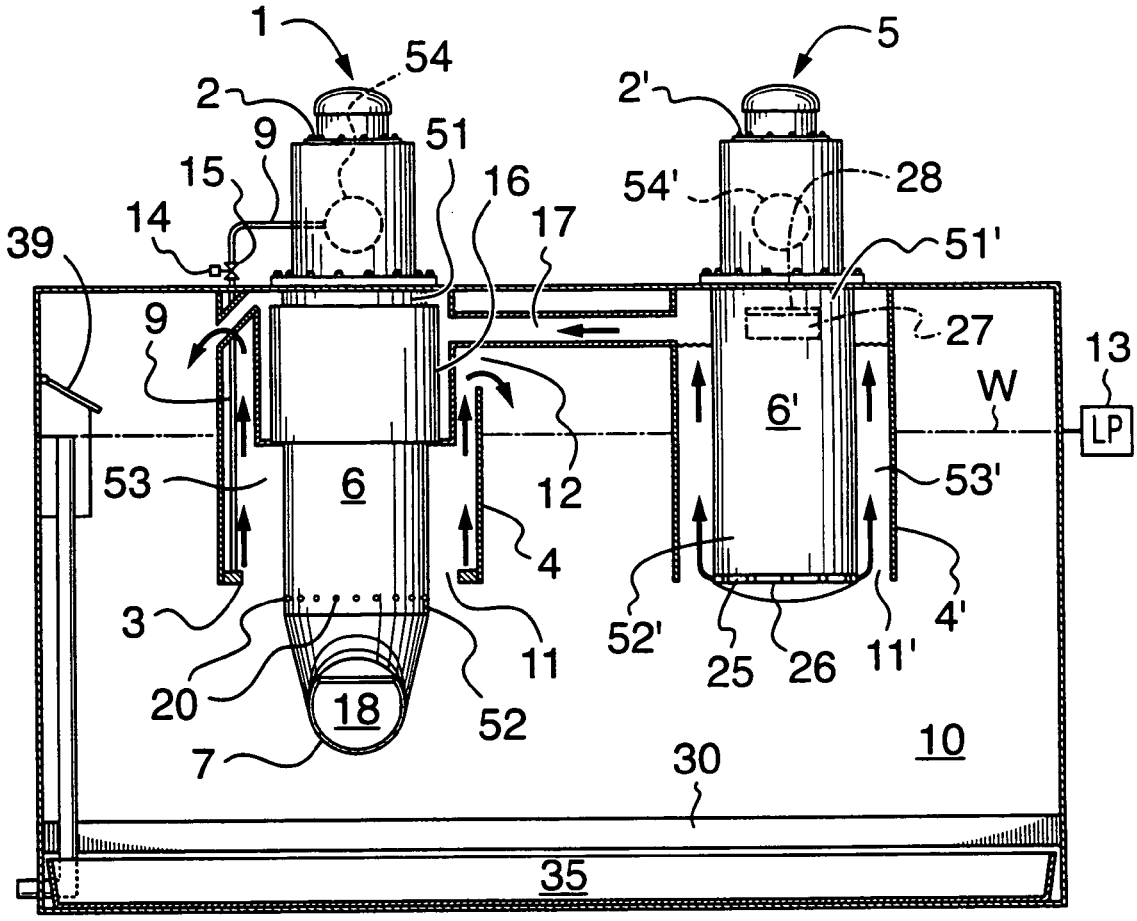
FIG. 1*a* is a schematic side sectional view of an example of a two-burner snow melter incorporating the snow-start burner assembly of the present invention.

The startup burner assembly (1) shown in FIG. 1*a* is provided together with a load burner assembly (5) which is similar to that described by Primas in Canadian Patent No. 780,673 and U.S. Pat. No. 3,187,743. Since load burner assembly (5) requires water for cooling, startup burner assembly (1) is provided to enable the "snow start" operation, i.e. ignition of the burner without initially supplying water as a coolant.

The startup burner assembly (1) incorporates a modified combustion chamber (6,7) comprising a downcomer tube (6) and a sparger tube (7). The downcomer tube (6) is affixed at the upper, or first end (51) thereof to a burner (2), and encloses a burner nozzle (50) of burner (2). The lower, or second end (52) of the downcomer tube (6) is joined to the sparger tube (7) in a substantially 90° orientation thereto. The sparger tube (7) has discharge holes (8) drilled therein, and extends outward, substantially horizontally, from the lower end (52) of the downcomer tube (6). During operation, products of combustion from the burner (2) are forced downwardly from the nozzle (50) through the downcomer tube (6), typically by the force of air from a blower (not shown) connected to the startup burner assembly by a blower pipe (54), and exit the burner assembly via the discharge holes (8) in the sparger tube (7) and through gas injection holes (20) formed in the downcomer tube (6). The gas injection holes (20) are drilled into the downcomer tube (6) in an annular arrangement about the downcomer, and are advantageously positioned above the 90° bend and below the lower level of a housing, or weir (4), which is described in greater detail below.

The discharge holes (8) are positioned and sized to suit the flow conditions of the burner assembly (1), and may be positioned variably around the sparger tube (7) as appropriate for the particular snow melting device. In particularly preferred embodiments, however, the discharge holes (8) are positioned on the upper portion of the sparger tube (7). By directing the warm air/products of combustion from the sparger tube (7) in an upward direction, agitation of the snow, initially, as and subsequently the meltwater accumulating in a receptacle, or tank (10), is increased, thus improving the efficiency of the snow melter. To remove any sediment that enters the sparger tube (8), a clean out door (18) may be provided at the end thereof.

To initiate the snow melting process, snow is loaded into the snow melting tank (10) and the burner (2) of startup burner assembly (1) is ignited. The products of combustion and heated air are forced through the discharge holes (8) in the sparger tube (7) and come into direct contact with the snow, causing the snow to melt. The operator loads more snow as required to maintain the tank (10) full of snow. The meltwater starts collecting on the tank bottom and the water level increases.

In order to prevent overheating of the downcomer tube (6) prior to it being cooled by the rising water level, the fuel input to burner (2) is controlled by a Programmable Logic Controller (PLC), such that the metal temperature of the downcomer tube (6) is maintained within an acceptable range. This also minimizes fuel waste resulting from undesired overheating of the downcomer tube (6). The firing rate may vary, depending upon the size of the burner, the fuel mixture, and the particular application for the snow melting device. Typical firing rates will be known to the skilled snow melter operator, and can be optimized based on the aforementioned parameters. Firing rates for the particular snow melting application may be easily entered using the PLC interface.

Programmable Logic Controllers are commonly known in the art, and are not specific to the invention. Thus, it will be known to one skilled in the art how to integrate and operate such a device together with the startup burner assembly described herein.

Figure 1B:
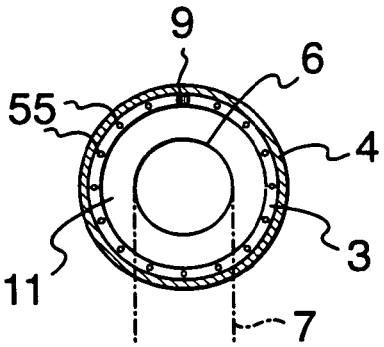
FIG. 1*b* is a top sectional view of the air injection manifold illustrated in FIG. 1*a;*
Figure 2:
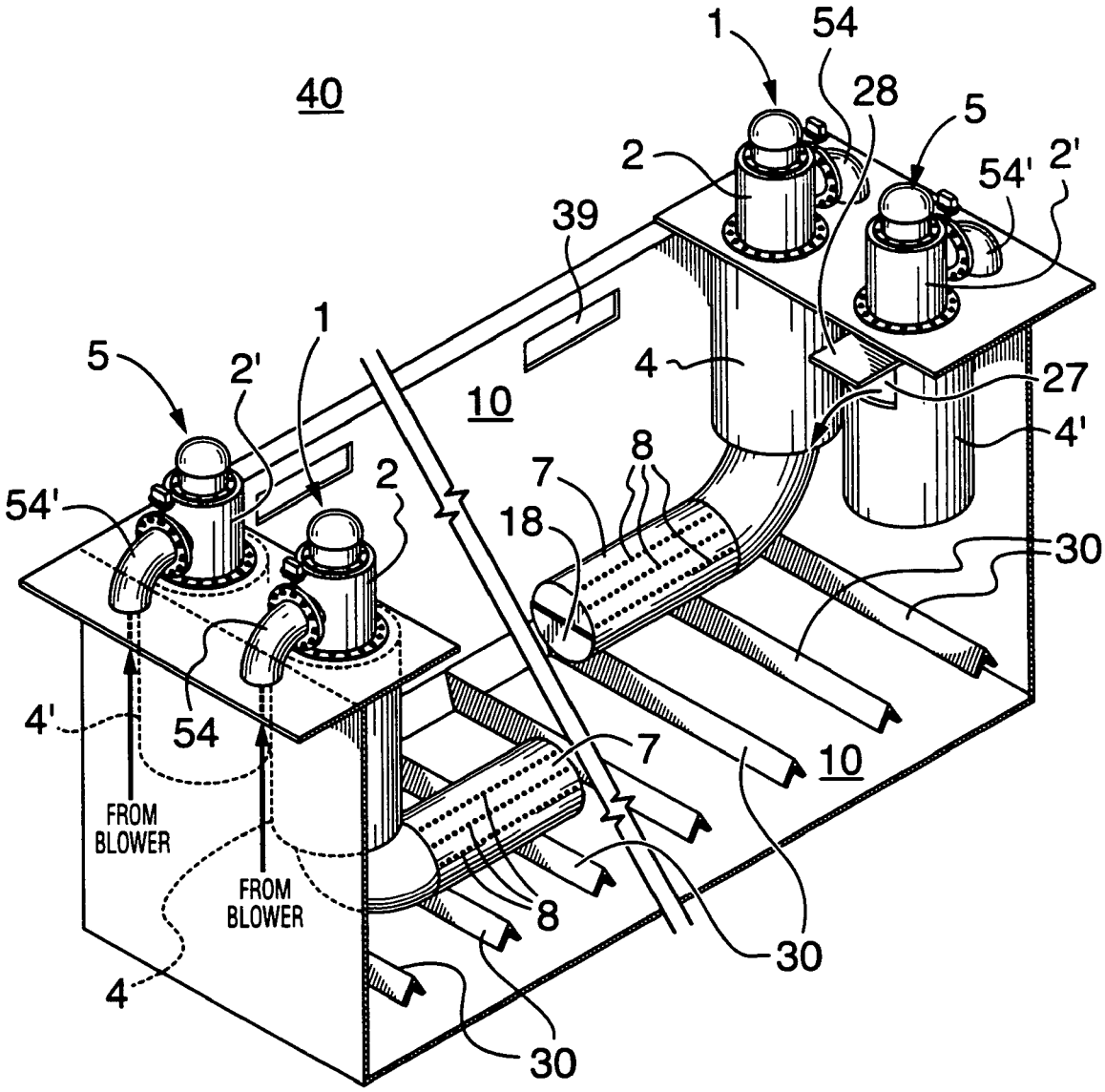
FIG. 2 is a top perspective view of an example of a four-burner snow melter incorporating the snow-start burner assembly of the present invention.
Figure 3:
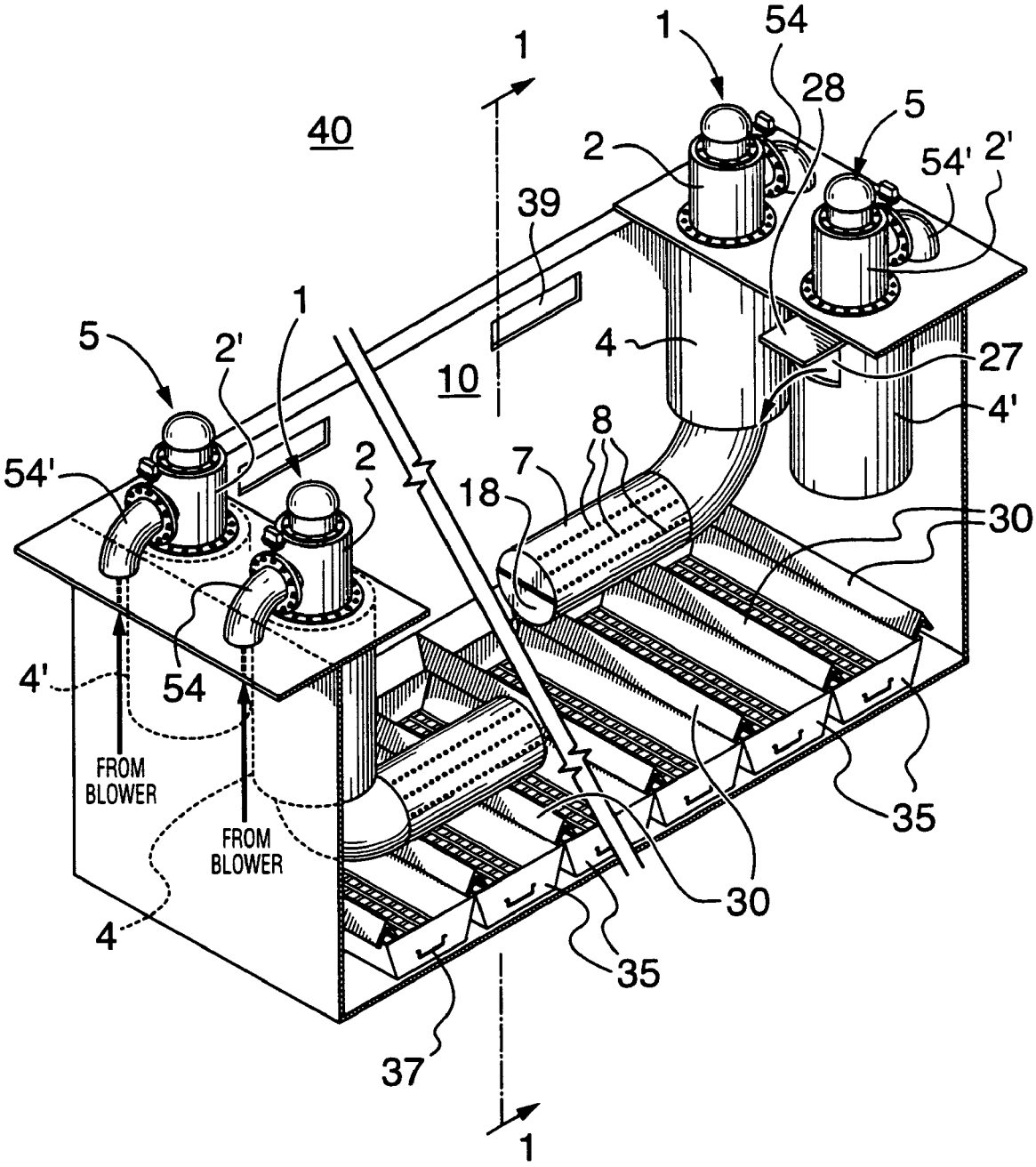
FIG. 3 is a top perspective view of the four-burner snow melter depicted in FIG. 2, further illustrating removable trays for evacuating debris.
Figure 4:
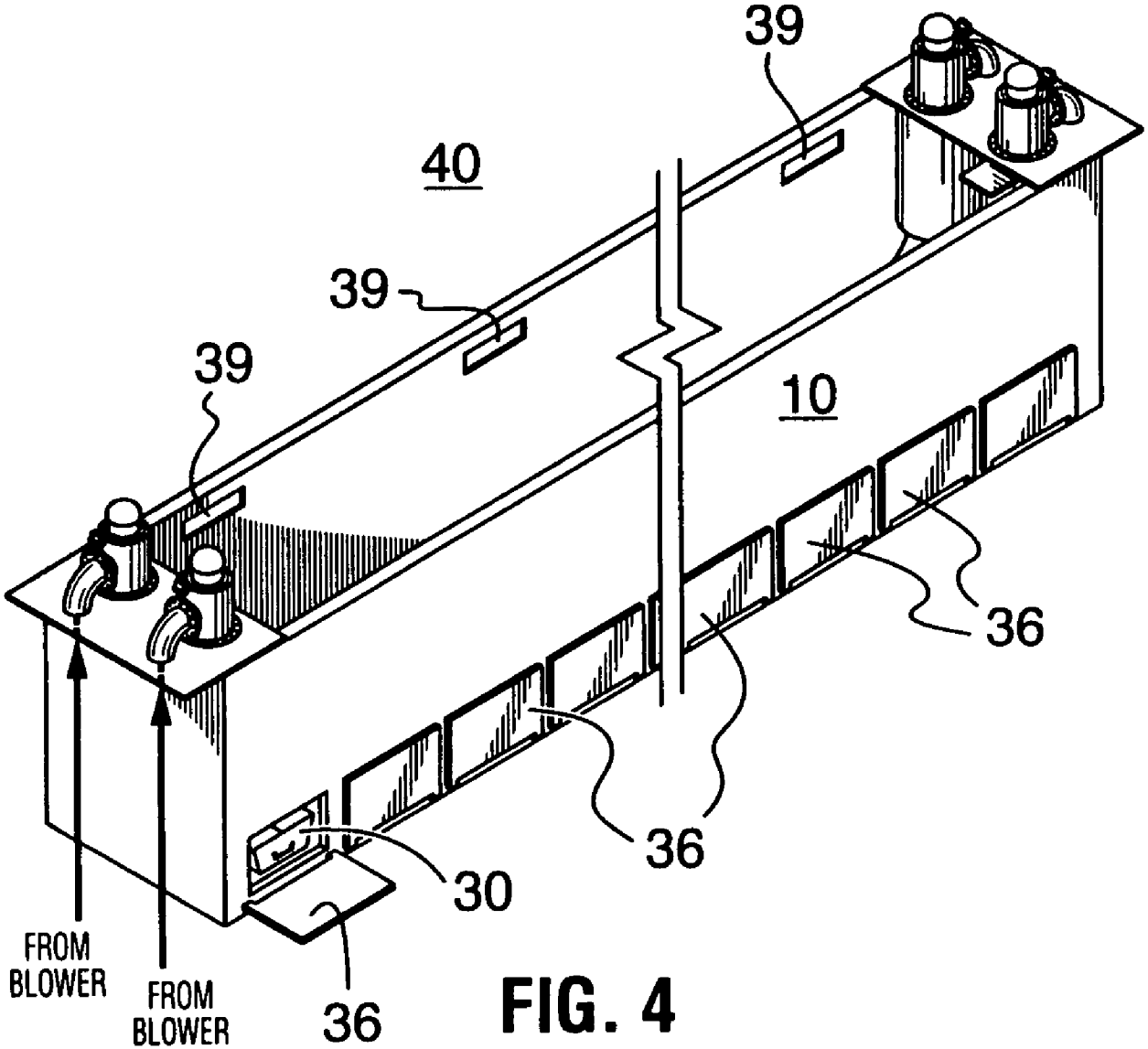
FIG. 4 is a side perspective view of the four-burner snow melter depicted in FIG. 2 illustrating the clean-out door provided for removing the removable trays.
Figure 5:
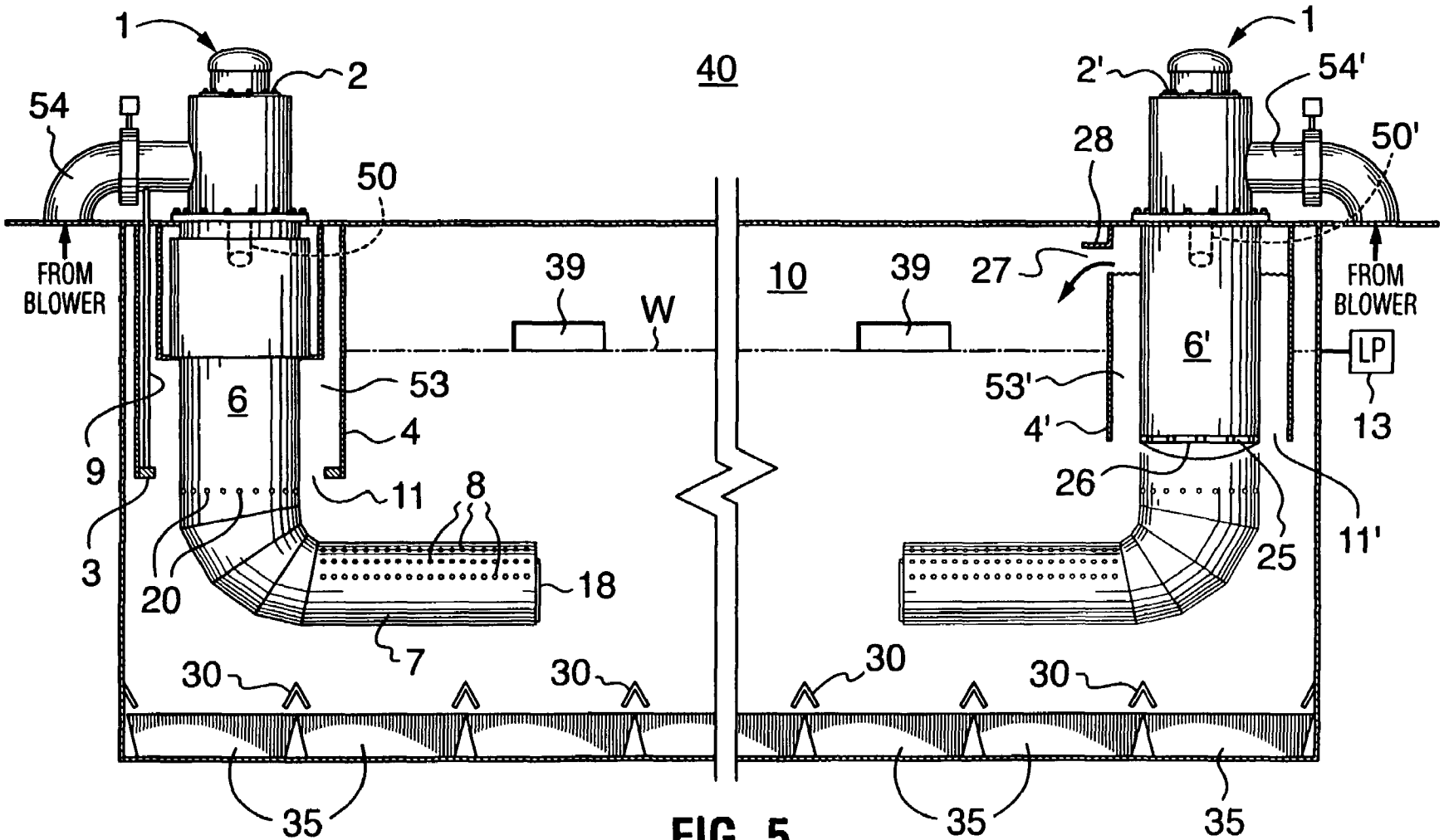
FIG. 5 is a side sectional view of the four-burner snow melter depicted in FIG. 2 illustrating the removable trays in cross section.

Cooling of the downcomer tube (6) during the initiation process is provided by means of an air injection manifold (3), which is illustrated in greater detail in FIG. 1*b*. The manifold (3), which forms part of an air cooling assembly (3,9), forms an annular ring around the downcomer tube (6), typically around the lower end (52) thereof, and introduces cooling air from the blower via air pipe (9), into the space (53) between the exterior of the downcomer tube (6) and the interior of the housing, or weir (4). Weir (4) envelops a substantial portion of the downcomer tube (6), and has openings (11,12) at the lower and upper regions thereof. A valve actuator (14) is advantageously provided, under control of the PLC, to adjust valve (15), which is positioned in pipe (9) to control the flow of air from blower pipe (54) to the air injection manifold (3). The air injection manifold may be provided in a variety of forms, although it is typically connected to the weir (4), e.g. by welding, at the lower end thereof such that holes, or exit ports (55) in the manifold direct air upwards into space (53).

Upon melting of the snow, the water level rises in the tank and enters weir (4) via lower weir opening (11). This provides further cooling to the downcomer tube (6), and results in heating of the water via direct heat transfer. The heated water within the weir (4) is forced upward (as represented by the arrows shown in FIG. 1*a*) due to the upward movement of air from the air injection manifold (3), and exits back into the tank (10) through upper weir opening (12) to mix with and further warm the accumulated snow/meltwater in the tank (10).

When the melting tank water level rises to the minimum water level necessary for normal operation (depicted by W in FIG. 1*a*), as detected by a level probe (13), the PLC program signals the ignition of the burner (2') of load burner assembly (5), and increases the input to both burners (2,2') causing continuous firing at the maximum set rate. Temperatures are measured at various points in the tank and burners are shut down for cooling when necessary, i.e., to maintain the metal temperature within an optimal melting range. The temperature of the meltwater in the tank may range from slightly above freezing temperature, typically 32 F for water although this may vary depending upon salt content, to approximately 100 F. An optimal temperature for snow melting using the apparatus described in FIG. 1*a* is approximately 38 F.

As mentioned above, the load burner assembly (5) is similar to that described by Primas. In particular, load burner assembly (5) includes a downwardly extending combustion chamber, or downcomer tube (6'), which is affixed at an upper, or first end (51'), thereof to the fuel burner (2'). The downcomer tube (6') encloses the burner nozzle (50') of the burner (2'), and is provided with an opening (25) at a lower, or second end (52') thereof, for the outflow of combustion gases from the sides. A closure (26) is disposed over the lower end (52') of the downcomer tube (6') at a distance away. A housing, or weir (4') is provided around the downcomer tube (6') forming an annular space (53') between the exterior of the downcomer tube (6') and the interior of weir (4'). The weir (4') has a bottom opening (11'), which may take the form of an open lower weir end, and an upper opening (27) at a location above the lower end (52') of the downcomer tube (6') for the outflow of combustion gases and hot water. Once water reaches level (W) in the tank and the burner (2') is ignited, combustion gases are discharged downwardly from the burner nozzle (50') through the downcomer tube (6') and out through the bottom opening (25) beneath the water, The combustion gases are forced upward by the buoyancy effect, and are projected upwardly through water in the weir (4'), which enters the weir (4') via lower weir opening (11') when the water level rises in the tank (10). The combustion gases heat the water and cause violent discharge thereof out of the opening (27) at the top of the weir (4'), the heated water striking the upper surface of the snow in the tank (10) and melting it. A deflector plate (28) may be positioned at the opening (27) to direct the heated water laterally onto the snow in the tank (10) and to prevent splashing directly upward.

In order to prevent overheating at high firing rates, a cooling jacket (16) may be arranged 10 around the non-submerged upper portion of the downcomer tube (6) of startup burner assembly (1). This is typically necessary since the upper portion of the downcomer tube (6) is not cooled by water spray from the weir (4), as for downcomer tube (6') of load burner assembly (5). In the example depicted in FIG. 1*a*, water from weir (4') of the adjacent load burner assembly (5) is supplied to cooling jacket (16) via crossover duct (17). Thus, as soon as there is any water flow out of the weir (4') on the load burner assembly (5), a portion of the water flow is fed into the cooling jacket (16) by the crossover duct (17). In the case of single burner snow melters, however, water may be supplied to the jacket (16) by an air-lift water ejector (not shown). It is to be understood that cooling jacket (16) is not required for the snow start operation, but is preferably included in the startup burner assembly (1) to facilitate cooling during mid- to high burner output.

The invention may be employed in many different types of snow melters and snow melting applications. For instance, it may be employed in towable, pit or self-propelled snow melters. Such self-propelled snow melters may include an auger arid a system of conveyors for collecting snow while advancing along a surface, such as a roadway, and propelling the snow into the melting tank. A bucket loader mounted on the front of a self-propelled snow melter is also envisioned, in which the operator drives into a pile of snow, fills the bucket horizontally, rotates the bucket and raises the bucket up and over the cab, and further rotates the bucket to empty the snow into the snow melting tank. The present invention may also be adapted for use in other snow melting applications.

With the exception of pit-melting applications, an overflow drain is typically required in snow melters of the present invention to maintain the level of water in the snow melting tank. One example of such an overflow drain is depicted in FIG. 1*a* as overflow (39). However, the form of such an overflow drain may vary without departing from the scope of the present invention.

A significant amount of debris may enter the snow melter along with the snow, such as garbage bags and contents, cans, bottles, parking meters, traction sand and grit, and a variety of other objects commonly scattered around roadways. The majority of this debris does not float, and may therefore settle on the bottom of the snow melting tank. Thus, during the snow removal/melting process, debris may build up and influence burner operation to the extent that water flow induced up the weir will decline and burner performance will be inhibited. In order to prevent debris from accumulating in the snow melter, and thus to improve the efficiency of the snow melting apparatus, a debris removal system may be incorporated.

The debris removal system may be any system known in the art. However, a preferred debris removal system for the snow melting apparatus of the present invention includes a set of lightweight removable trays, into which debris may settle. FIGS. 2 to 5 illustrate an example of a four-burner embodiment of the present snow melting device having the aforementioned debris removal system.

In this example, snow melter (40) is shown to include a plurality of rails (30) for guiding the removable trays (35) in and out of the lower section of snow melting tank (10). The rails (30) preferably run laterally across the bottom of the tank (10) just below the sparger tubes (7) and at approximately the height of the removable trays (35). The rails (30) may also be shaped such that the upper portions thereof have a pyramidal cross-section, thus facilitating the deflection of falling debris into the trays (35). The number and shape of the trays (35) may vary, although it is preferred to have the trays arranged throughout substantially the entirety of the tank floor. It is also preferred, though not required, for the trays to have a water-penetrable, e.g., grated bottom, so as to prevent residual water from accumulating therein when the tank (10) is drained. Providing a grated bottom to the removable trays (35) also maintains the weight of the trays at a minimum, and facilitates their easy removal from the snow melter (40). For cleaning, the tank (10) is drained, the clean-out doors (36) opened, the trays (35) pulled out of the snow melter (40) using handles (37) and the contents dumped. The trays (35) are then replaced and the snow loading recommenced with a "snow start".

The foregoing are exemplary embodiments of the present invention and a person skilled in the art would appreciate that modifications to these embodiments may be made without departing from the scope and spirit of the invention.

The invention claimed is:

1. A startup burner assembly for use in a snow melting apparatus, the startup burner assembly comprising:

a fuel burner having adjustable combustion output and including a nozzle to facilitate the emergence of products of combustion, a combustion chamber having a first portion in substantially air-tight communication with the fuel burner and enclosing the nozzle, and a second portion shaped and dimensioned for disposition into a snow melting receptacle or pit, the combustion chamber having a plurality of discharge holes formed at least on the second portion thereof to permit the egress of products of combustion from the fuel burner into the tank or pit, and thereby permit agitation and melting of snow loaded therein, and an air cooling assembly for supplying air to cool at least the first portion of the combustion chamber the air cooling assembly comprising an air injection manifold and an air supply tube for supplying air from an air supply to the air injection manifold, the manifold being formed around the first portion of the combustion chamber and having holes facilitating the emergence of air to cool the first portion of the combustion chamber.

2. The startup burner assembly according to claim 1 wherein the first portion of the combustion chamber comprises a downcomer tube and the second portion of the combustion chamber comprises a sparger tube, a first end of said downcomer tube being in substantially air communication with the fuel burner, and a second end of said downcomer tube being in substantially air-tight communication with the sparger tube, the downcomer tube enclosing the fuel burner nozzle and being in a substantially perpendicular orientation with the sparger tube.

3. The startup burner assembly according to claim 2, further comprising a housing surrounding at least a portion of the downcomer tube and displaced radially outwardly therefrom, the housing defining a space between the exterior of the downcomer tube and the interior of the housing to facilitate the receiving of air from the air cooling assembly to cool the downcomer tube, the housing having openings to permit water to enter the space, and to permit the air, water, or both thereof to exit the space.

4. The startup burner assembly according to claims 1, further comprising a jacket around at least part of the first portion of the combustion chamber, the jacket being shaped and dimensioned to receive a flow of water for cooling of said first portion of the combustion chamber.

5. The startup burner assembly according to claim 2, wherein the discharge holes are formed on an upper surface of the sparger tube along substantially the entire length thereof.

6. A startup burner assembly for use in a snow melting apparatus, the startup burner assembly comprising:

a fuel burner having adjustable combustion output and including a nozzle to facilitate the emergence of products of combustion, wherein the combustion output of the fuel burner is controllable by a Programmable Logic Controller, a combustion chamber having a first portion in substantially air-tight communication with the fuel burner and enclosing the nozzle, and a second portion shaped and dimensioned for disposition into a snow melting receptacle or pit, the combustion chamber having a plurality of discharge holes formed at least on the second portion thereof to permit the egress of products of combustion from the fuel burner into the tank or pit, and thereby permit agitation and melting of snow loaded therein, and an air cooling assembly for supplying air to cool at least the first portion of the combustion chamber.

7. A snow melting apparatus comprising a receptacle for receiving snow, one or more startup burner assemblies as defined in claim 1 mounted in operable arrangement with the receptacle, at least one air supply means to supply air to the air cooling assembly and combustion chamber of each of the one or more startup burner assemblies via a pipe, and a controller for controlling the combustion output of the fuel burner of each of the one or more startup burner assemblies.

8. The snow melting apparatus according to claim 7, wherein the controller comprises a Programmable Logic Controller operably linked to the fuel burners of the one or more startup burner assemblies.

9. The snow melting apparatus according to claim 7, where the controller is operably linked to the air supply means and controls the output thereof.

10. The snow melting apparatus according to 7, wherein the air supply means is a blower.

11. The snow melting apparatus according to claim 7, wherein one or more of the startup burner assemblies comprises an adjacent load burner assembly, said load burner assembly comprising: a load burner having a nozzle to facilitate the emergence of products of combustion, a combustion chamber extending downwardly into the receptacle and having a first end in substantially air-tight communication with the load burner and substantially enclosing the nozzle thereof, and an open second end to which an end plate is secured at a distance therefrom to form an annular lateral space between the end plate and the open second end of the combustion chamber, a housing surrounding at least a portion of the combustion chamber and displaced radically outwardly therefrom, the housing defining a space between the exterior of the combustion chamber and the interior of the housing and having upper and lower openings respectively at upper and lower ends of the housing, the lower end of the housing being disposed below the end plate of the combustion chamber.

12. The snow melting apparatus according to claim 11, further comprising a crossover duct connecting the housing of the load burner assembly with, and for supplying water to, a jacket of the adjacent startup burner assembly, the jacket being arranged around at least part of the first portion of the combustion chamber of the startup burner assembly, the jacket being shaped and dimensioned to receive a flow of water from the housing of the load burner assembly via said crossover duct for cooling of said first portion of the combustion chamber.

13. The snow melting apparatus according to claim 11, wherein the housing of the load burner assembly comprises a deflector plate at or near the upper opening thereof for laterally deflecting water projected from said housing during operation of the snow melter.

14. The snow melting apparatus according to claim 7, further comprising one or more collecting tray, the collecting tray being effective to collect debris which accumulates in the receptacle during operation, and wherein the receptacle comprises one or more resealable door for evacuating the collecting tray from the receptacle.

15. The snow melting apparatus according to claim 14, wherein the collecting tray has a grated bottom and is positioned below the combustion chamber of the startup burner assembly at or near a bottom surface of the receptacle, the one or more resealable doors being positioned in a sidewall of the receptacle in alignment with the position of the collecting tray.

16. The snow melting apparatus according to claim 14, wherein the snow melting apparatus comprises a plurality of said collecting trays and resealable doors, the collecting trays covering substantially the entire bottom surface of the receptacle, and the number of resealable doors being equal to the number of collecting trays.

17. A method of snow melting comprising the steps of: providing snow to a snow melting apparatus according to claim 7 such that the snow is in contact with at least the second portion of the combustion chamber of the startup burner assembly, supplying fuel and oxygen to the fuel burner of the startup burner assembly, igniting the fuel burner of the startup burner assembly, adjusting input of the fuel and oxygen to the fuel burner of the startup burner assembly so as to provide a low burner output, and supplying air to the air cooling assembly of the startup burner assembly to cool at least the first portion of the combustion chamber of the startup burner assembly.

18. The method according to claim 17, wherein snow melting at said low burner output is continued until a level of water is obtained from the snow melting which is sufficient to cool at least part of the first portion of the combustion chamber of the startup burner assembly.

19. The method according to claim 18, further comprising a step of increasing air and fuel input to the fuel burner of the startup burner assembly, said step of increasing air and fuel input being conducted simultaneously with or subsequent to achieving the level of water defined in claim 18.

20. A snow melting apparatus comprising a receptacle for receiving snow, one or more burner assembly mounted in operable arrangement with the receptacle, and one or more collecting tray within the receptacle, the collecting tray being effective to collect debris which accumulates in the receptacle during operation, and wherein the receptacle comprises one or more resealable door for evacuating the collecting tray from the receptacle.

21. The snow melting apparatus according to claim 20, wherein the collecting tray has a grated bottom and is positioned at or near a bottom surface of the receptacle, the one or more resealable doors being positioned in a sidewall of the receptacle in alignment with the position of the collecting tray.

22. The snow melting apparatus according to claim 20, wherein the snow melting apparatus comprises a plurality of said collecting trays and resealable doors, the collecting trays covering substantially the entire bottom surface of the receptacle, and the number of resealable doors being equal to the number of collecting trays.

23. The snow melting apparatus according to claim 20, wherein the collecting tray is further defined by a substantially planar grated bottom and sidewalls extending substantially upwardly therefrom.

24. The snow melting apparatus according to claim 23, wherein the sidewalls are outwardly tapered with respect to the substantially planar grated bottom.

* * * * *